US008611579B2

(12) United States Patent
Console

(10) Patent No.: US 8,611,579 B2
(45) Date of Patent: Dec. 17, 2013

(54) MICROPHONE ASSEMBLY FOR REMOVABLE ATTACHMENT TO SURFACE

(75) Inventor: James Console, Portland, OR (US)

(73) Assignee: James Console, Portland, OR (US)

( * ) Notice: Subject to any disclaimer, the term of this patent is extended or adjusted under 35 U.S.C. 154(b) by 0 days.

(21) Appl. No.: 13/468,778

(22) Filed: May 10, 2012

(65) Prior Publication Data

US 2013/0051599 A1 Feb. 28, 2013

Related U.S. Application Data

(60) Provisional application No. 61/529,221, filed on Aug. 30, 2011.

(51) Int. Cl.
*H04R 25/00* (2006.01)

(52) U.S. Cl.
USPC ..... 381/375; 381/355; 381/361; 381/366

(58) Field of Classification Search
USPC ..... 381/355–356, 362, 366, 374–375, 379
See application file for complete search history.

(56) References Cited

U.S. PATENT DOCUMENTS

| | | | | |
|---|---|---|---|---|
| D371,133 | S | 6/1996 | Andrea | |
| 7,013,492 | B2 | 3/2006 | Hugh et al. | |
| 7,920,903 | B2 | 4/2011 | Ueda et al. | |
| 2002/0131616 | A1* | 9/2002 | Bronnikov et al. | 381/370 |
| 2007/0036386 | A1 | 2/2007 | Amae | |
| 2009/0103761 | A1 | 4/2009 | Fan | |
| 2009/0116678 | A1* | 5/2009 | Bevirt et al. | 381/381 |
| 2009/0268935 | A1 | 10/2009 | Dillinger | |
| 2009/0323975 | A1 | 12/2009 | Groesch | |
| 2010/0014699 | A1* | 1/2010 | Anderson et al. | 381/375 |
| 2010/0040251 | A1* | 2/2010 | Schreiber | 381/368 |
| 2011/0143820 | A1* | 6/2011 | Heil | 455/569.1 |

OTHER PUBLICATIONS

FraGTaLiTy's Audio-Technica AD700 boom mic Mod, http://www.head-fi.org/t/446329/fragtalitys-audio-technica-ad700-boom-mic-mod, 7 pages, accessed on Apr. 4, 2012.

SteelSeries—Console Gaming Headsets—SteelSeries Siberia V2 for PS3, SteelSeries—Console Gaming Headsets—SteelSeries Siberia V2 for PS3, http://steelseries.com/products/consoles/steelseries-siberia-v2-for-ps3, 6 pages, accessed on Apr. 4, 2012.

Office Action dated Dec. 14, 2012, Chinese Application No. 201220438326.9, filed Aug. 30, 2012.

* cited by examiner

*Primary Examiner* — Brian Ensey
*Assistant Examiner* — Sabrina Diaz
(74) *Attorney, Agent, or Firm* — Plumsea Law Group, LLC

(57) ABSTRACT

A microphone assembly is operable to be removably attached to a surface. The microphone assembly includes a microphone and a microphone support that operably supports the microphone. The microphone assembly further includes a coupling assembly that is operable to removably connect the microphone support to the surface. The coupling assembly includes at least one magnet that magnetically and removably attaches the microphone support to the surface.

21 Claims, 2 Drawing Sheets

MICROPHONE ASSEMBLY FOR REMOVABLE ATTACHMENT TO SURFACE

CROSS-REFERENCE TO RELATED APPLICATIONS

This application claims the benefit of U.S. Provisional Application No. 61/529,221, filed on Aug. 30, 2011. The entire disclosure of the above application is incorporated herein by reference.

FIELD

The present disclosure relates to a microphone and, more particularly, relates to a microphone assembly for removable attachment to a surface.

BACKGROUND

This section provides background information related to the present disclosure which is not necessarily prior art.

Many devices include permanently attached microphones for converting sound waves into electric signals that can be transmitted to a remote location and converted back into sound waves via a speaker. For instance, many headphones or headsets include permanently attached headphones. The headphones can include a frame that supports one or more speakers to be positioned adjacent a respective ear of the user, and a microphone can extend from the frame to be disposed adjacent the wearer's mouth.

However, permanently attached microphones can be disadvantageous. For instance, the speakers included in a set of headphones can be high quality while the microphone is of low quality, or vice versa. However, buying headphones with both high quality speakers and a high quality microphone can be prohibitively expensive. Furthermore, there can be situations in which the user wants to use the microphone independent of the headphones, but this can be difficult given the microphone's permanent attachment to the headphones.

SUMMARY

This section provides a general summary of the disclosure, and is not a comprehensive disclosure of its full scope or all of its features.

A microphone assembly is disclosed that is operable to be removably attached to a surface. The microphone assembly includes a microphone and a microphone support that operably supports the microphone. The microphone assembly further includes a coupling assembly that is operable to removably connect the microphone support to the surface. The coupling assembly includes at least one magnet that magnetically and removably attaches the microphone support to the surface.

A microphone assembly is also disclosed that is operable to be removably attached to a surface. The microphone assembly includes a microphone and a microphone support that operably supports the microphone. Additionally, the microphone assembly includes a coupling assembly that is operable to removably connect the microphone support to the surface. The coupling assembly includes a first coupling member that is attached to the microphone support. The coupling assembly also includes a second coupling member that is operable to attach to the surface. The first coupling member has a first engaging surface and the second coupling member has a second engaging surface. One of the first and second engaging surfaces includes a plurality of projections and the other of the first and second engaging surfaces include a plurality of recesses that are complimentary to the plurality of projections. The plurality of projections are removably received in corresponding ones of the plurality of recesses to engage the first and second engaging surfaces. The first and second engaging surfaces are operable to selectively and removably engage each other at a plurality of predetermined orientations relative to each other.

Moreover, a microphone assembly is disclosed that is operable to retrofit an audio headset with at least one speaker mount having a speaker mounted thereon. The speaker mount is operable to mount the speaker adjacent to an ear of a user. The speaker mount includes an outer surface. The microphone assembly includes a microphone and a wire that carries signals from the microphone. The microphone assembly further includes a flexible tube that supports the microphone at one end and that includes a longitudinal passage that receives the wire. The flexible tube is operable to flex between a first set position and a second set position. The microphone assembly additionally includes a first coupling member with a slot that receives the flexible tube. The first coupling member includes a first engaging surface with a plurality of alternating ascending and descending first ramp surfaces. The alternating ascending and descending first ramp surfaces are arranged about an axis. The first coupling member also includes a first magnet. Additionally, the microphone assembly includes a cap member that threadably attaches to the first coupling member to secure the flexible tube inside the slot. Moreover, the microphone assembly includes a second coupling member with a second engaging surface having a plurality of alternating ascending and descending second ramp surfaces. The alternating ascending and descending second ramp surfaces are arranged about the axis. The first ramp surfaces are nestingly and removably engaged with the second ramp surfaces to allow the first coupling member to be selectively rotated about the axis relative to the second coupling member between a plurality of predetermined orientations relative to the second coupling member. The second coupling member also includes a second magnet that is magnetically attracted to the first magnet to removably and magnetically retain the first and second coupling members together. Additionally, the second coupling member includes an adhesive member for adhesively attaching to the outer surface of the speaker mount.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
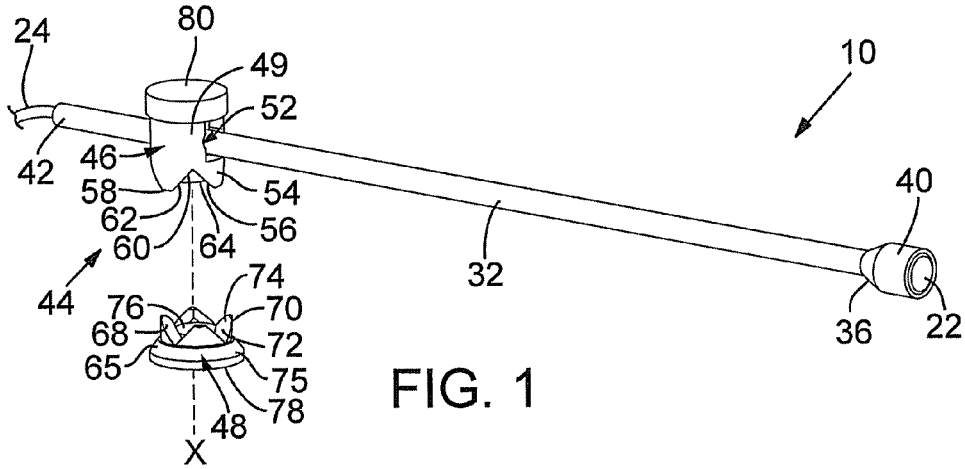
FIG. 1 is a partially exploded perspective view of a microphone assembly according to exemplary embodiments of the present disclosure.
Figure 2:
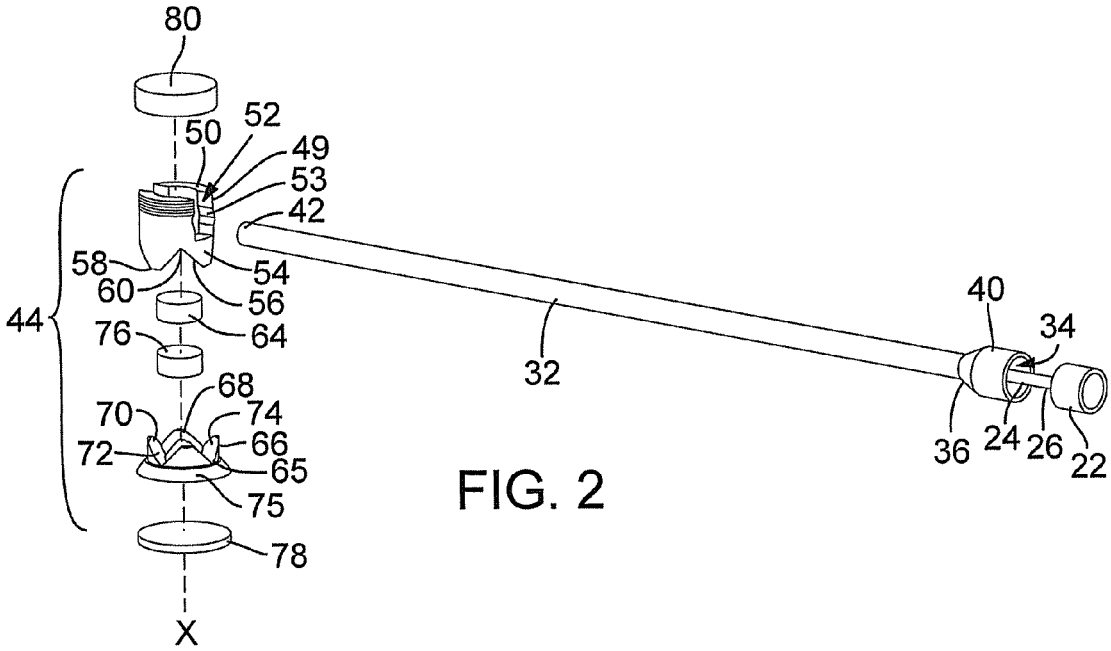
FIG. 2 is an exploded perspective view of the microphone assembly of FIG. 1.
Figure 3:
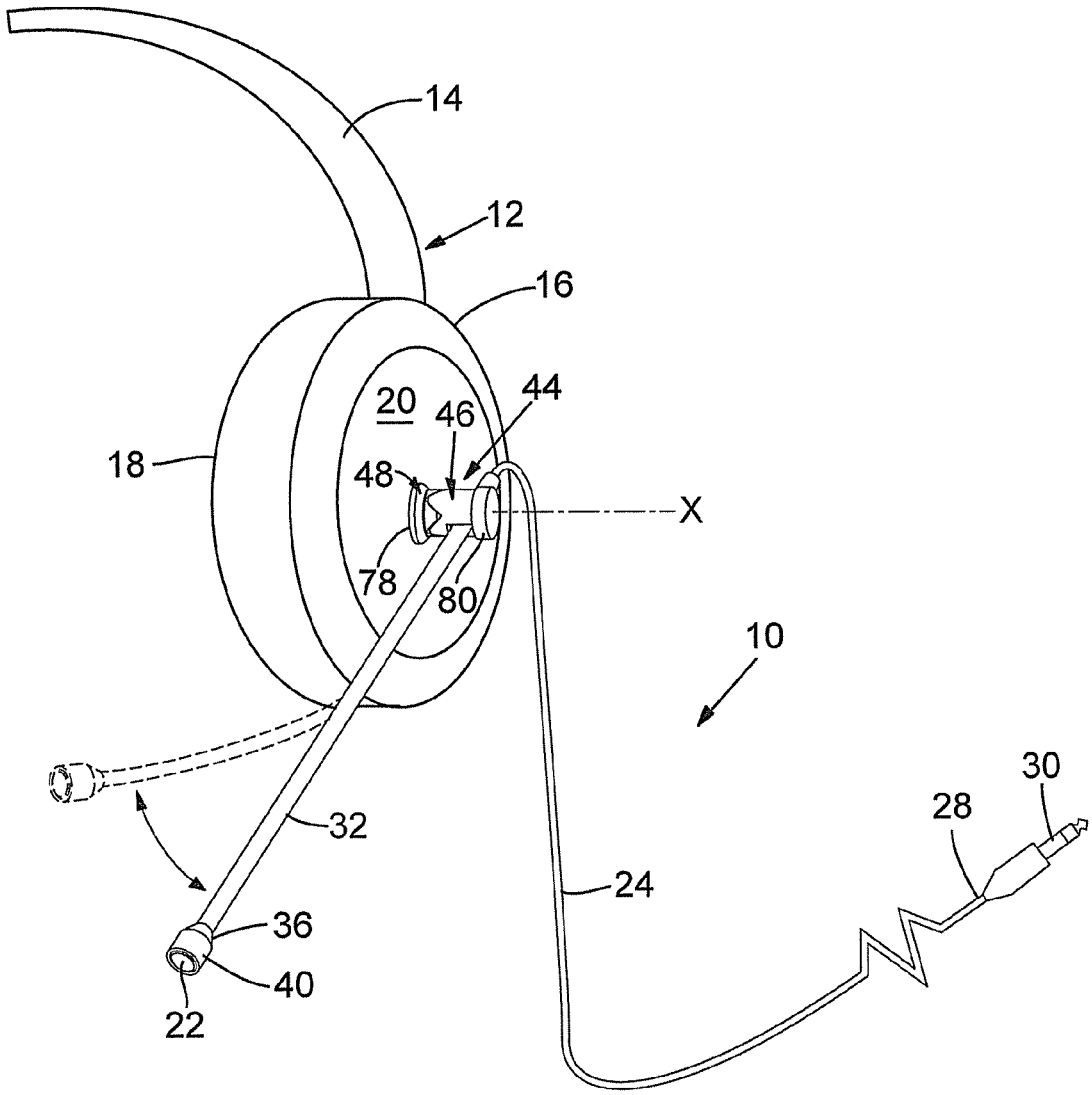
FIG. 3 is a perspective environmental view of the microphone assembly of FIG. 1 according to exemplary embodiments of the present disclosure.

Referring to FIGS. 1-3 a microphone assembly 10 is illustrated according to exemplary embodiments of the present disclosure. As shown in FIG. 3, the microphone assembly 10 can be removably attached to a surface 20 (FIG. 3). Thus, as will be discussed, the user can temporarily attach and mount the microphone assembly 10 to the surface 20 and, when desired, the user can remove the microphone assembly 10 from the surface 20 (e.g., for storage when not in use, etc.).

In some embodiments represented in FIG. 3, the surface 20 can be defined on an audio headset 12 (i.e., headphones, etc.) such that the microphone assembly 10 can be used for retrofitting the headset 12 from an audio-output device to a combination audio-output and audio-input device. However, it will be appreciated that the surface 20 could be defined on any object other than a headset 12 without departing from the scope of the present disclosure.

It will be appreciated that the headset 12 represented in FIG. 3 can be a commercially-available headset 12 of any suitable type. Thus, the headset 12 can include a head support 14, such as a band that extends superiorly and transversely over the user's head (not shown) between each ear. The headset 12 can also include one or more speaker mounts 16, which support a respective speaker 18 adjacent the user's ear (not shown). The surface 20 can be an exterior surface 20 of the speaker mount 16 in some embodiments. However, as mentioned above, the surface 20 can be defined anywhere on the headset 12 or on any other object other than the headset 12. Also, it will be appreciated that the headset 12 can be configured differently from the embodiments shown in FIG. 3.

Referring to FIGS. 1 and 2, the microphone assembly 10 will be discussed in detail. The microphone assembly 10 can include a microphone 22 or other similar transducer that translates audio into corresponding electrical signals. The microphone can be a commercially-available and/or prior art microphone 22 with a diaphragm that is vibrated by sound waves (e.g., the user's voice), and the microphone 22 can convert those vibrations to corresponding electrical signals. The microphone 22 can be relatively small and can have a short, cylindrical shape. Also, the microphone 22 can be a "voice tube-type" microphone.

A flexible wire 24 can transmit electrical signals from the microphone 22 to a receiver (not shown). The wire 24 can include metallic wiring that is embedded within a polymeric covering in some embodiments. The wire 24 can include a first end 26 and a second end 28. The first end 26 can be fixed to the microphone 22, and the second end 28 can include a connector 30, such as a standard 3.5 millimeter, male, TRS connector (i.e., stereo plug, headphone jack, etc.) or other type of connector. It will also be appreciated that the microphone 22 can be a wireless microphone such that the wire 24 is not included.

The microphone assembly 10 can further include a microphone support 32 (e.g., a boom). The microphone support 32 can be a flexible, malleable hollow tube with a passage 34 extending therethrough. The microphone support 32 can be of any suitable type (e.g., a polymeric tube, a metal spine wire, a gooseneck tube, a solid metal tube, etc.). The microphone support 32 can include a first end 36 with a cup 40 that receives and operably supports the microphone 22. Also, the wire 24 can be received within the passage 34 and can extend from the first end 36 to a second end 42. The wire 24 can extend freely from the second end 42 as shown in FIG. 3. The microphone support 32 can be elongate such that the microphone assembly 10 can operate similar to a boom microphone (i.e., the microphone 22 can be spaced from the surface 20 and can be disposed adjacent the user's mouth). Also, in some embodiments where the microphone 22 is a "voice tube-type," the microphone 22 can receive sound waves at the first end 36, and the sound waves can travel along the support 32 to a diaphragm (not shown), which is disposed at the second end 42 of the support 32.

Also, the microphone support 32 can be adjustably flexed between a plurality of set positions, and the microphone support 32 can substantially hold at the set position. For instance, in the embodiments shown in FIG. 3, the microphone support 32 is shown at a first set position (shown in solid lines), and the microphone support 32 is also shown at a second set position (shown in phantom lines). Thus, the user can selectively move and adjust the position of the support 32, for instance, to move the microphone 22 relative to the user's mouth.

The assembly 10 can further include a coupling assembly 44 that is operable to removably connect the microphone support 32 (and, thus, the microphone 22) to the surface 20. In some embodiments, the coupling assembly 44 can removably and magnetically connect the microphone support 32 to the surface 20 via at least one magnet. For instance, the surface 20 can be made from a ferromagnetic material, and the magnet can magnetically and removably attach thereto. In additional embodiments that will be discussed, the coupling assembly 44 includes a plurality of magnets for removably attaching the microphone support 32 to the surface 20. It will be appreciated, however, that the coupling assembly 44 can attach the microphone support 32 to the surface 20 in any other fashion (e.g., snap-fit members, hook-and-loop fastener tapes, etc.).

In some embodiments, the coupling assembly 44 can generally include a first coupling member 46 that is attached to the microphone support 32 and a second coupling member 48 that is operable to be attached to the surface 20. The first and second coupling members 46, 48 can removably connect to each other. In some embodiments, the coupling members 46, 48 attach via magnets, as will be discussed. In additional embodiments, the coupling members 46, 48 attach mechanically. In still additional embodiments, the coupling members 46, 48 rely on a combination of magnetic attraction and mechanical engagement to removably attach. It will be appreciated, however, that the first and second coupling members 46, 48 can removably attach in any suitable fashion without departing from the scope of the present disclosure.

Embodiments of the first coupling member 46 are shown in detail in FIGS. 1 and 2. As shown, the first coupling member 46 can include a hollow, tubular first base 49. The first base 49 can include a first end 50 that includes a transverse slot 52 extending through the rim of the first end 50. The slot 52 can receive the second end 42 of the microphone support 32. In some embodiments, the microphone support 32 can be wedged and retained in the slot 52 via friction between the base 49 and the microphone support 32. In additional embodiments, the slot 52 can include a notch 53 that widens the slot 52 and that receives the microphone support 32 such that the other, narrower portions of the slot 52 will interfere with movement of the microphone support 32 out of the slot 52. In still more embodiments, the slot 52 can include a projection (not shown), such as a rib, a rail, etc. that also interferes with movement of the microphone support 32 out of the slot 52.

The first base 49 can also include a second end 54 that includes an engaging surface 56. The engaging surface 56 can engage the second coupling member 48 as will be discussed.

The engaging surface 56 can include a plurality of projections 58 and a plurality of recesses 60 that are alternatingly arranged about an axis X. In some embodiments, the alternating projections 58 and recesses 60 can taper such that the projections 58 and recess 60 have a saw-tooth profile that annularly extends about the axis X. Thus, the engaging surface 56 can be defined by alternating ascending and descending ramp surfaces 62. The ramp surfaces 62 can extend helically about the axis X and can have any suitable slope. Also, the apexes of the projections 58 and/or the deepest parts of the recesses 60 can be pointed, rounded, flat (i.e., perpendicular to the axis X), etc.

The first coupling member 46 can additionally include a first magnet 64. The first magnet 64 can be a disc-shaped permanent magnet that is received in the first base 49. The first magnet 64 can be retained inside the first base 49 via friction between the outer surface of the first magnet 64 and the inner surface of the first base 49. In additional embodiments, the first magnet 64 can be retained via an interference fit (e.g., the first base 49 can include one or more surfaces that extend inwardly to limit movement of the first magnet 64 out of the first base 49 along the axis X). Also, in some embodiments, the first magnet 64 can be embedded within the first base 49.

Also, the second coupling member 48 can also include a hollow, tubular second base 65. The second base 65 can include a first end 66 with a second engaging surface 68. The second engaging surface 68 can be complimentary and can correspond to the first engaging surface 56 such that the first and second engaging surfaces 56, 68 can nestingly engage. More specifically, the second engaging surface 68 can include a plurality of projections 70 and recesses 72 that are alternatingly arranged about the axis X. Also, the projections 70 and recesses 72 can taper such that the projections 70 and recesses 72 can have a saw-tooth profile that annularly extends about the axis X. Thus, the engaging surface 68 can be defined by alternating ascending and descending ramp surfaces 74. The ramp surfaces 74 can extend helically about the axis X and can have any suitable slope. The apexes of the projections 70 and/or the deepest parts of the recesses 72 can be pointed, rounded, flat (i.e., perpendicular to the axis X), etc. The second ramp surfaces 74 of the second engaging surface 68 can nest and engage the first ramp surfaces 62 of the first engaging surface 56 as will be discussed in detail below.

The second base 65 can additionally include a second end 75. The second end 75 can be frustoconic in shape such that the second end 75 tapers radially outward like a skirt from the first end 66.

Furthermore, the second coupling member 48 can include a second magnet 76. The second magnet 76 can be a disc-shaped permanent magnet that is received in the second base 65. The second magnet 76 can be retained inside the second base 65 via friction between the outer surface of the second magnet 76 and the inner surface of the second base 65. In additional embodiments, the second magnet 76 can be retained via an interference fit. Moreover, in some embodiments, the second magnet 76 can be embedded within the second base 65.

Still further, the second coupling member 48 can include an adhesive member 78. The adhesive member 78 can be a round pad of double-sided adhesive tape, foam, etc. One side of the adhesive member 78 can be adhesively attached to the second end 75 of the second base 65 as shown in FIG. 1. The opposite side of the adhesive member 78 can be adhesively attached to the surface 20 of the headset 12 as shown in FIG. 3. It will be appreciated, however, that the second coupling member 48 can be attached to the surface 20 in any other fashion (e.g., glue, a screw or other fastener, a tie, etc.). Also, although the adhesive member 78 and the second end 75 of the second base 65 are flat in the illustrated embodiments, the adhesive member 78 and the second end 75 can be contoured to thereby readily attach to a non-flat surface 20.

Additionally, the microphone assembly 10 can include a cap 80. The cap 80 can removably attach to the first end 50 of the first coupling member 46 as shown in FIG. 3. In some embodiments, the cap 80 can threadably attach and partially receive the first end 50 of the first coupling member 46. Thus, the cap 80 can cover the slot 52 and can retain the microphone support 32 therein.

In order to retrofit the headset 12, the adhesive member 78 of the second coupling member 48 can be adhesively attached to the surface 20. Then, the first coupling member 46 can be moved along the axis X toward the second coupling member 48. Once the first coupling member 46 is close enough to the second coupling member 48, the second magnet 76 can magnetically attract the first magnet 64 and pull the first coupling member 46 into engagement with the second coupling member 48. Specifically, the projections 58 of the first coupling member 46 can be nestingly received within corresponding recesses 72 of the second coupling member 48, and recesses 60 of the first coupling member can nestingly receive projections 70 of the second coupling member 48. As the first coupling member 46 is magnetically pulled toward the second coupling member 48, the ramp surface 62 can abut against and slide on the ramp surface 74 to rotate the first coupling member 46 relative to the second coupling member 48 about the axis X such that the first and second engaging surfaces 56, 68 meshingly engage.

As shown in FIG. 3, the wire 24 can extend out of the microphone support 32 and can be extended from the surface 20 such that the connector 30 can be operably connected to a receiver (not shown). It will be appreciated that an entirety of the wire 24 can be free of the surface 20 (i.e., does not penetrate through the surface 20) and the wire 24 can be independent of the headset 12. Thus, the microphone assembly 10 can be used without having to form holes in the surface 20 and/or without having to disassemble the headset 12.

Once the microphone assembly 10 is removably attached to the headset 12, the microphone support 32 can be bent to hold the microphone 22 at a desired position relative to the user's mouth. Also, if desired, the user can rotate the first coupling member 46 relative to the second coupling member 48 about the axis X. (The user might make this type of adjustment to move the microphone 22 far away from the user's mouth.) By rotating the first coupling member 46 about the axis, the first ramp surfaces 62 can slide on the second ramp surfaces 74 about the axis X such that the second ramp surfaces 74 push the first coupling member 46 away from the second coupling member 48 in a direction parallel to the axis X. Then, once the first projections 58 advance to adjacent second recesses 72, the second magnet 76 can attract the first magnet 64 to pull the first coupling member 46 back toward the second coupling member 48.

In some embodiments, the magnets 64, 76 can have a relatively strong attraction such that the first coupling member 46 is pulled toward the second coupling member 48 even as the first coupling member 46 is rotated about the axis X relative to the second coupling member 48 and the second ramp surfaces 74 push the first ramp surfaces 62 away. Thus, the first coupling member 46 is unlikely to lose contact with the second coupling member 48, and the coupling assembly 44 is unlikely to inadvertently disassemble during adjustment.

Accordingly, the microphone assembly 10 can provide a convenient means for removably supporting a microphone 22 on a surface 20. In some embodiments, the microphone assembly 10 can be used to conveniently retrofit an existing headset 12. Thus, the user can pair the microphone 22 with a desired headset 12 for playing videogames, for making phone calls, or for other uses.

Also, the microphone assembly 10 can be highly and conveniently adjustable. For instance, the microphone support 32 can be bent and flexed into a plurality of set positions for positioning the microphone 22 in a desirable position relative to the user's mouth. Furthermore, the length of the microphone support 32 extending from the first coupling member 46 can be adjusted (e.g., by sliding the support 32 longitudinally in the slot 52, etc.). Also, the magnets 64, 76 can allow the microphone 22 to be quickly, conveniently, and repeatedly attached to and detached from the headset 12 or other surface 20. Furthermore, the first and second ramp surfaces 62, 74 can selectively nest and engage in one of a plurality of predetermined orientations about the axis X. In the illustrated embodiments, there are four predetermined orientations that are evenly spaced at every ninety degrees. However, the engaging surfaces 56, 68 of the coupling assembly 44 can be varied to include more or less projections 58, 70 and recesses 60, 72, and the projections 58, 70 and recesses 60, 72 can be spaced differently to allow for other predetermined orientations.

Additionally, even if the surface 20 of the headset 12 is outside the line-of-sight of the user while the user is wearing the headset 12, the user can quickly and conveniently couple the first coupling member 46, the microphone support 32, and the microphone 22 to the surface 20 without looking. Then, the user can make large positional adjustments by rotating the first coupling member 46 about the axis X relative to the second coupling member 48 and/or make fine positional adjustments by bending the microphone support 32. Accordingly, the microphone 22 can be conveniently moved to a desired position relative to the user's mouth.

Moreover, if the user wishes to remove the microphone 22 from the headset 12, the user can easily remove the first coupling member 46 from the second coupling member 48. Then, the first magnet 64 can be conveniently attached to another ferro-magnetic surface for secure storage of the assembled first coupling member 46, the microphone support 32, and the microphone 22.

In additional embodiments, the assembly 10 can include only one of the first and second magnets 64, 76. The other can be replaced by a ferrous member. Thus, the one remaining magnet 64, 76 can be magnetically attracted to the ferrous member for magnetically attaching the first coupling member 46 to the second coupling member 48.

In still additional embodiments, the microphone assembly 10 can include a switch for selectively turning the microphone 22 ON and OFF. For instance, the switch can include a first electrical contact that is mounted on the first engaging surface 56 and a corresponding second electrical contact that is mounted on the second engaging surface 68. The electrical circuit for the microphone 22 can incorporate these contacts. These electrical contacts can electrically connect in a predetermined orientation of the first coupling member 46 relative to the second coupling member 48 (e.g., in an orientation where the microphone 22 is positioned adjacent the user's mouth). In other orientations, the contacts can be electrically disconnected from each other. Thus, by rotating the first coupling member 46 relative to the second coupling member 48, the user can consequently switch the microphone 22 ON and OFF.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A microphone assembly operable to be removably attached to a surface, the microphone assembly comprising:

a microphone;

a microphone support that operably supports the microphone; and a coupling assembly that is operable to removably connect the microphone support to the surface, the coupling assembly including:

a first coupling member, a cap member that is attached to the first coupling member such that the cap member and the first coupling member cooperate to enclose and retain a portion of the microphone support, a second coupling member that is operable to attach to the surface independent of the first coupling member, and at least one magnet that is fixed to one of the first coupling member and the second coupling member, the at least one magnet magnetically and removably attaching the one of the first coupling member and the second coupling member to the other of the first coupling member and the second coupling member.

2. The microphone assembly of claim 1, wherein the first coupling member includes a first magnet, wherein the second coupling member includes a second magnet, and wherein the first coupling member and the second coupling member are removably attached together via a magnetic attraction between the first magnet and the second magnet.

3. The microphone assembly of claim 2, wherein the first coupling member has a first engaging surface and the second coupling member has a second engaging surface, the first engaging surface and the second engaging surface operable to selectively engage each other at a plurality of predetermined orientations relative to each other.

4. The microphone assembly of claim 3, wherein the first engaging surface and the second engaging surface are operable to rotate about an axis relative to each other to move between the plurality of preset orientations relative to each other.

5. The microphone assembly of claim 4, wherein one of the first engaging surface and the second engaging surface includes a projection and the other of the first engaging surface and the second engaging surface includes a recess that receives the projection to engage the first and second engaging surfaces.

6. The microphone assembly of claim 5, wherein the one of the first engaging surface and the second engaging surface includes a plurality of projections and the other of the first engaging surface and the second engaging surface includes a plurality of recesses that are complimentary to the plurality of projections, the plurality of projections including a plurality of first ramp surfaces and the plurality of recesses including a plurality of second ramp surfaces, the second ramp surfaces operable to push the first ramp surfaces to push the first coupling member away from the second coupling member when one of the plurality of projections is advanced toward an adjacent one of the plurality of recesses.

7. The microphone assembly of claim 1, wherein the microphone support is flexible and is operable to be flexed between a first set position and a second set position.

8. The microphone assembly of claim 1, further comprising a wire that carries signals from the microphone, an entirety of the wire being free from the surface.

9. The microphone assembly of claim 2, wherein the first coupling member includes an end with a slot that receives the microphone support.

10. The microphone assembly of claim 9, wherein the cap member is removably attached to the end of the first coupling member to at least partially cover the slot to secure the microphone support in the slot of the first coupling member.

11. The microphone assembly of claim 2, wherein the second coupling member is operable to removably connect to a headset, the headset including the surface.

12. The microphone assembly of claim 1, wherein the at least one magnet is fixed to the first coupling member, wherein the at least one magnet magnetically and removably attaches the first coupling member to the second coupling member.

13. A microphone assembly operable to be removably attached to a surface, the microphone assembly comprising:

a microphone;

a microphone support that operably supports the microphone; and a coupling assembly that is operable to removably connect the microphone support to the surface, the coupling assembly including a first coupling member that is attached to the microphone support, the coupling assembly also including a second coupling member that is operable to attach to the surface, the first coupling member having a first engaging surface and the second coupling member having a second engaging surface, one of the first and second engaging surfaces including a plurality of projections and the other of the first and second engaging surfaces including a plurality of recesses that are complimentary to the plurality of projections, the plurality of projections being removably received in corresponding ones of the plurality of recesses to engage the first and second engaging surfaces, the first and second engaging surfaces operable to selectively and removably engage each other at a plurality of predetermined orientations relative to each other, wherein the first coupling member includes a first magnet and the second coupling member includes a second magnet that is magnetically attracted to the first magnet to removably and magnetically retain the first and second coupling members together.

14. The microphone assembly of claim 13, wherein the plurality of projections include a plurality of first ramp surfaces and the plurality of recesses include a plurality of second ramp surfaces, the second ramp surfaces operable to push the first ramp surfaces to push the first coupling member away from the second coupling member when one of the plurality of projections is advanced toward an adjacent one of the plurality of recesses.

15. The microphone assembly of claim 13, wherein the plurality of projections are arranged about an axis, and the plurality of recesses are arranged about the axis, the first engaging surface operable to rotate about the axis relative to the second engaging surface to move between the plurality of preset orientations.

16. The microphone assembly of claim 13, wherein at least one of the first magnet and the second magnet is a permanent magnet.

17. The microphone assembly of claim 13, wherein the microphone support is flexible and is operable to be flexed between a first set position and a second set position.

18. The microphone assembly of claim 13, further comprising a wire that carries signals from the microphone, an entirety of the wire being free from the surface.

19. The microphone assembly of claim 13, wherein the first coupling member includes a slot that receives the microphone support.

20. The microphone assembly of claim 13, wherein the second coupling member is operable to removably connect to a headset, the headset including the surface.

21. A microphone assembly operable to retrofit an audio headset with at least one speaker mount having a speaker mounted thereon, the speaker mount operable to mount the speaker adjacent to an ear of a user, the speaker mount including an outer surface, the microphone assembly comprising:

a microphone;

a wire that carries signals from the microphone;

a flexible tube that supports the microphone at one end and that includes a longitudinal passage that receives the wire, the flexible tube operable to flex between a first set position and a second set position;

a first coupling member with a slot that receives the flexible tube, the first coupling member including a first engaging surface with a plurality of alternating ascending and descending first ramp surfaces, the alternating ascending and descending first ramp surfaces being arranged about an axis, the first coupling member also including a first magnet;

a cap member that threadably attaches to the first coupling member to secure the flexible tube inside the slot;

a second coupling member with a second engaging surface having a plurality of alternating ascending and descending second ramp surfaces, the alternating ascending and descending second ramp surfaces being arranged about the axis, the first ramp surfaces nestingly and removably engaged with the second ramp surfaces to allow the first coupling member to be selectively rotated about the axis relative to the second coupling member between a plurality of predetermined orientations relative to the second coupling member, the second coupling member also including a second magnet that is magnetically attracted to the first magnet to removably and magnetically retain the first and second coupling members together, the second coupling member also including an adhesive member for adhesively attaching to the outer surface of the speaker mount.

* * * * *